US006394227B1

(12) United States Patent
Frestad

(10) Patent No.: US 6,394,227 B1
(45) Date of Patent: May 28, 2002

(54) SCAFFOLD STRUCTURE

(76) Inventor: Rune Frestad, Fløyveien 4, Flekkefjord (NO), 4400

( * ) Notice: Subject to any disclaimer, the term of this patent is extended or adjusted under 35 U.S.C. 154(b) by 0 days.

(21) Appl. No.: 09/486,400

(22) PCT Filed: Aug. 27, 1998

(86) PCT No.: PCT/NO98/00259

§ 371 (c)(1),
(2), (4) Date: Feb. 25, 2000

(87) PCT Pub. No.: WO99/11886

PCT Pub. Date: Mar. 11, 1999

(30) Foreign Application Priority Data

Sep. 2, 1997 (NO) ..... 974018

(51) Int. Cl.[7] ..... E04G 1/20
(52) U.S. Cl. ..... 182/82; 182/45
(58) Field of Search ..... 182/82, 146, 141, 182/149, 148

(56) References Cited

U.S. PATENT DOCUMENTS 4,392,550 A * 7/1983 Bergeron ..... 182/82
4,942,940 A * 7/1990 Boeshart ..... 182/82

FOREIGN PATENT DOCUMENTS

GB 2014638 * 8/1979

* cited by examiner

*Primary Examiner*—Alvin Chin-Shue
(74) *Attorney, Agent, or Firm*—Sierra Patent Group Ltd

(57) ABSTRACT

A scaffold structure which includes two or more legs (1, 2) intended for erection to compensate large differences in height on an underlying surface substantially parallel with a work or contact surface, at a distance therefrom. The legs (1, 2) at their upper ends, when erected, are in a known way per se bent inwards or provided with spacers (5, 5') facing towards the work or contact surface in order to produce the said distance. Moreover, the points of impact of the legs (1, 2) against the underlying surface are offset outwards from the work or contact surface relative to the leg portions (4, 4') that are substantially parallel to the work or contact surface. The legs (1, 2) can be connected to a platform (3) at mutually different levels and with varying distances between the legs (1, 2) dependent upon the state of the underlying surface. At the bottom of the middle leg portion (4, 4') there is a safety foot (7) which is capable of being moved downwards telescopically so that it almost touches the ground in order to provide safety in the event of the scaffold sliding out from the wall.

4 Claims, 8 Drawing Sheets

SCAFFOLD STRUCTURE

The present invention relates to a scaffold structure as disclosed in claim 1.

Existing scaffolds are ill-suited for use in connection with light exterior work such as house painting, applying weatherstripping to windows or the like in those cases where the performer of the task is not going to remain in the same place for very long.

This is especially the case when the underlying surface is undulating or uneven, since in that event a scaffold cannot be moved by being shifted via wheels mounted on the scaffold. In general, it takes too long to move and re-erect a scaffold in order to adapt it to the underlying surface.

When painting a house wall, where the ground is uneven, which is often the case for private houses, as a rule ladders are used, as usually it is only possible to gain access with an access platform on one or perhaps two sides of the house.

European Patent Publication EP A1-0 330 642 makes known an arrangement for cleaning windows where a platform is arranged on a ladder. This platform can be moved up and down, and the ladder can be moved sideways along a wall surface. This arrangement normally requires a fixed assembly and is not very suitable for dismantling, moving and reassembly.

U.S. Pat. No. 3,620,332 makes known a ladder of the steps type where the step supporting legs are bent outwards at the bottom so as to obtain a greater distance between the legs, thereby increasing stability.

DT 2442069 A1 makes known ladder and steps embodiments, including a ladder where the upper end of the ladder legs is bent inwards in the form of a wall rest to enable the ladder to be put up having a greater distance to the wall, especially at the top.

European Patent Publication EP 0 355 504 A1 makes known an extension piece which can be mounted on a ladder at the upper end in order to increase the distance to the wall at the top of the ladder.

DT 25 06 528 A1 makes known a platform which, with the aid of a screw, spirals upwards on a fixed ladder. This device normally requires a fixed assembly and is not very suitable for dismantling, moving and reassembling.

U.S. Pat. No. 715,944 makes known a ladder which is put up almost vertically. The ladder has a spacer at the top to create distance from the wall to ensure that there is room for the work platform which runs up and down on the inside of the ladder. At the bottom, two stabilising legs are mounted for lateral stabilisation and to prevent the structure from falling outwards from the wall.

GB 2 12 2572 makes known a ladder which is put up almost vertically. The ladder has a spacer at the top to create distance from the wall to ensure that there is room for the work platform which runs up and down on the inside of the ladder. At the bottom of the ladder there are fixed feet which face backwards in order to prevent the structure from falling outwards from the wall.

U.S. Pat. No. 3,760,902 makes known a ladder which is put up almost vertically. The ladder has a spacer at the top to create distance from the wall to ensure that there is room for the work platform which runs up and down on the inside of the ladder. At the bottom of the ladder there are fixed feet which face backwards and outwards in order to prevent the structure from falling outwards from the wall and to provide lateral stability.

None of the aforementioned publications describe arrangements which are suitable for laterally inclined underlying surfaces.

The object of the present invention is to obviate the drawbacks of the aforementioned arrangements and provide a scaffold which via its structure and function will automatically adjust to the majority of forms of uneven underlying surfaces.

This is achieved by means of a scaffold structure of the type mentioned above whose characterising features are set forth in claim 1.

Thus, the invention relates to a scaffold which consists of two separate legs and a platform.

Each of the legs is in contact with the ground via preferably just one point and the wall at one point. This means that the legs can without additional measures be placed close to a wall despite an uneven and undulating underlying surface.

In this way, both legs can be positioned side by side in parallel relation, and if the underlying surface is uneven will, if necessary, be on different levels.

The legs can be produced in different lengths, e.g., 2 meters, 3.5 meters and 5 meters, so as to be capable of being used for walls of different heights.

The platform is mounted horizontally and in movable interaction with the legs.

The legs have the facility of being mounted on the platform at levels different from one another, and with variable width, depending upon what the ground and the wall call for. When the differences in level sideways are very great, two legs of different lengths can be used.

The platform will then be capable of being moved up and down along the legs with the aid of a winch, rack and pinion, by being lifted manually or in another technically known way, manually or motor-driven.

If necessary, a safety brake can be incorporated which will act as an extra safety mechanism if, e.g., the wire should snap when, for instance, the platform is being winched up.

The user can ascend and descend by being on the platform and hoisting/running himself up and down, or by being on the ground and hoisting/running the platform up and down in order to then enter it with the aid of, e.g., a ladder.

Additional features of the invention are set forth in the other dependent claims.

Below, the invention will be described in more detail with reference to the drawings, wherein.

Figure 4A:
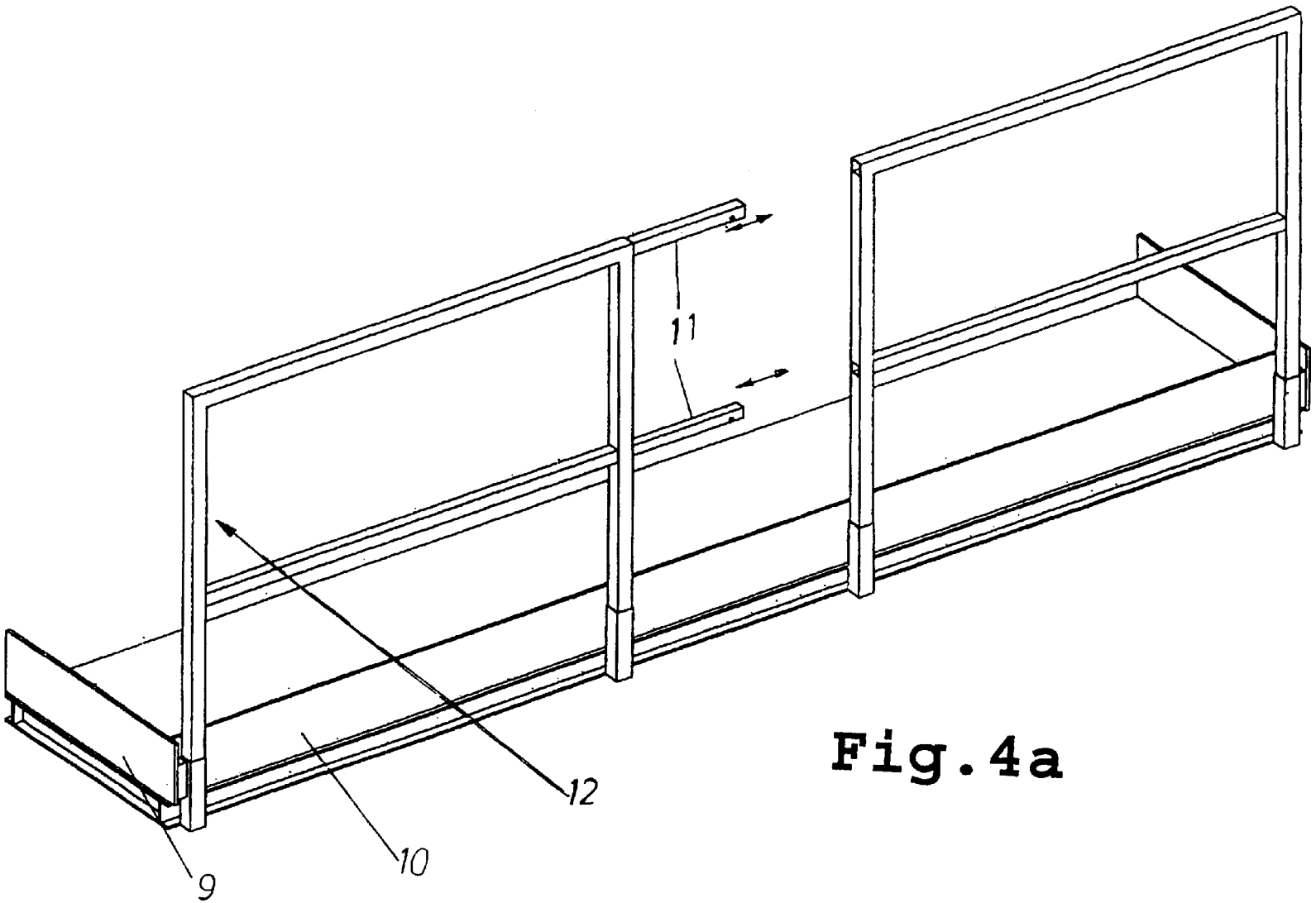

FIG. 4*a* shows the platform with side members.

Figure 4B:
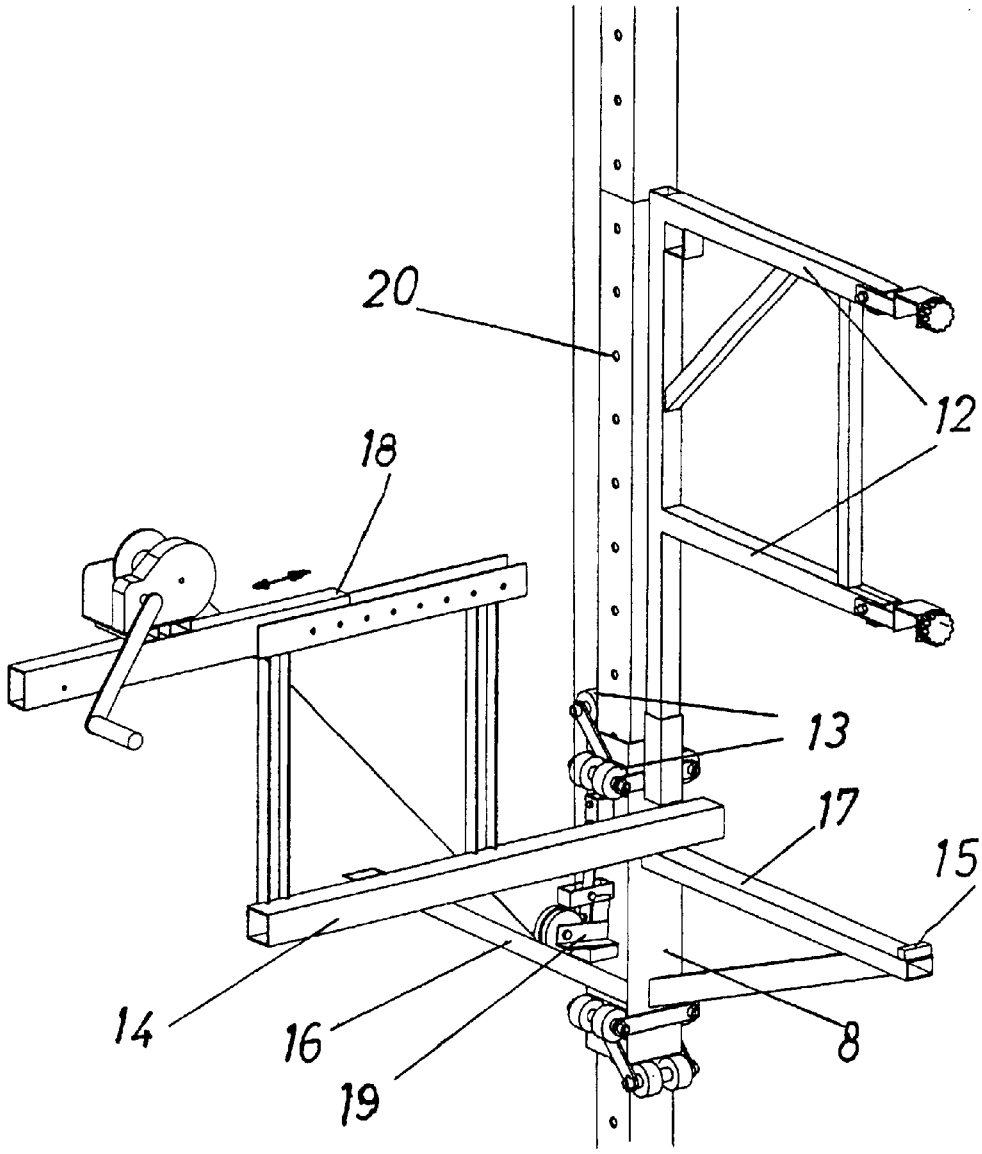

FIG. 4*b* shows details of the platform's attachment to a leg.

Figure 4C:
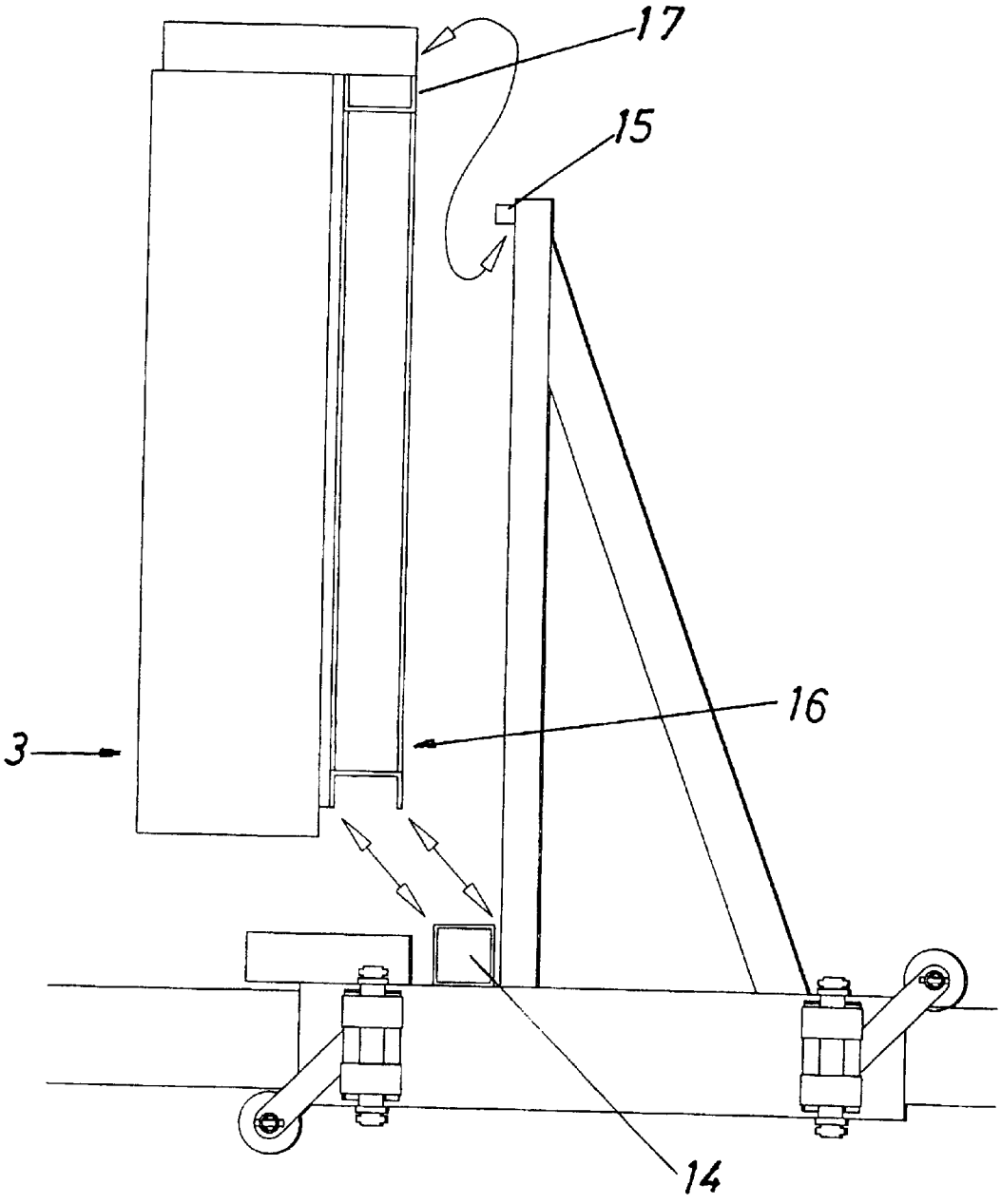

FIG. 4*c* shows details of the platform and a leg.

Figure 5:
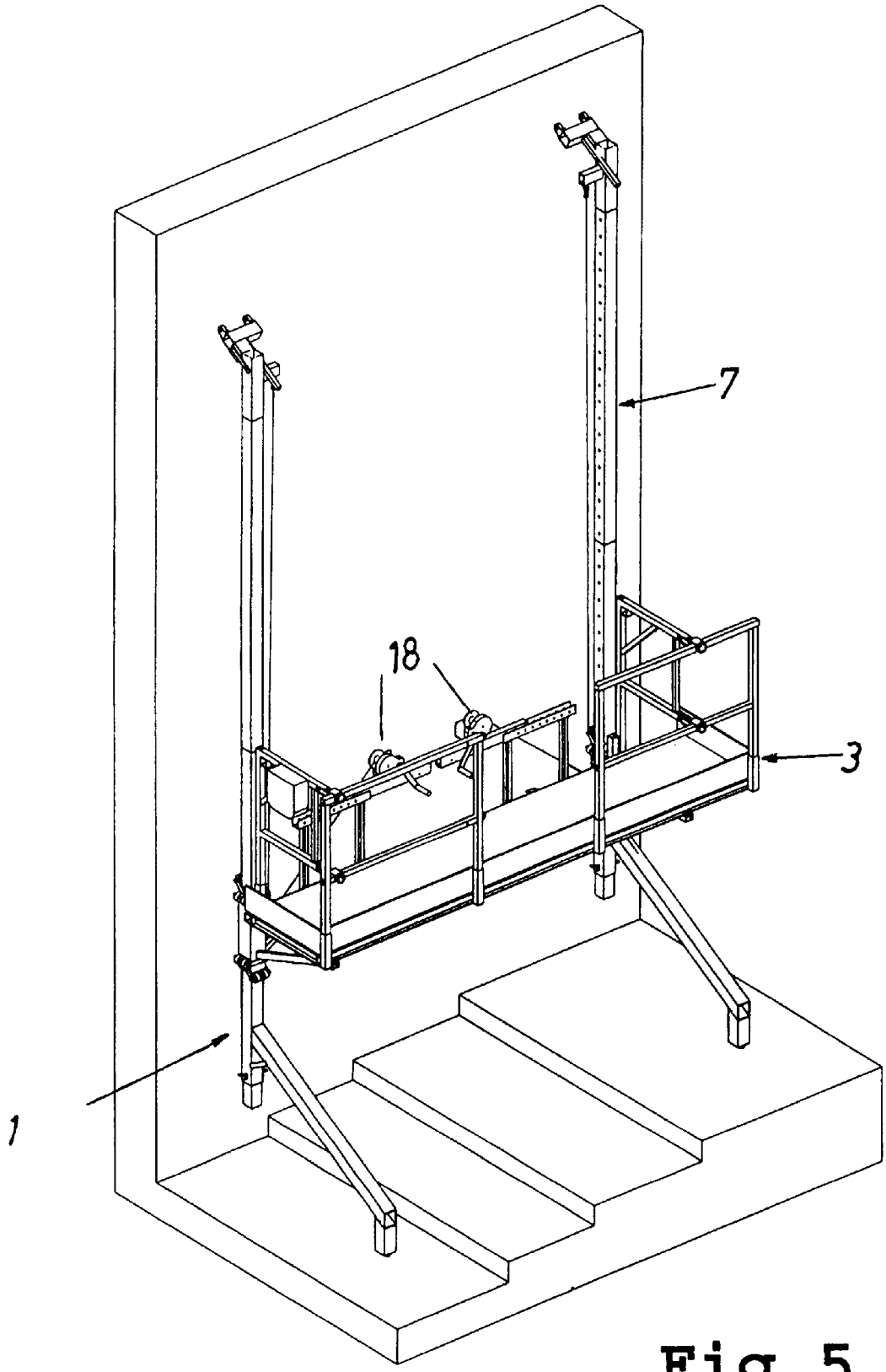

FIG. 5 is a perspective view of the scaffold on an uneven underlying surface.

Figure 6:
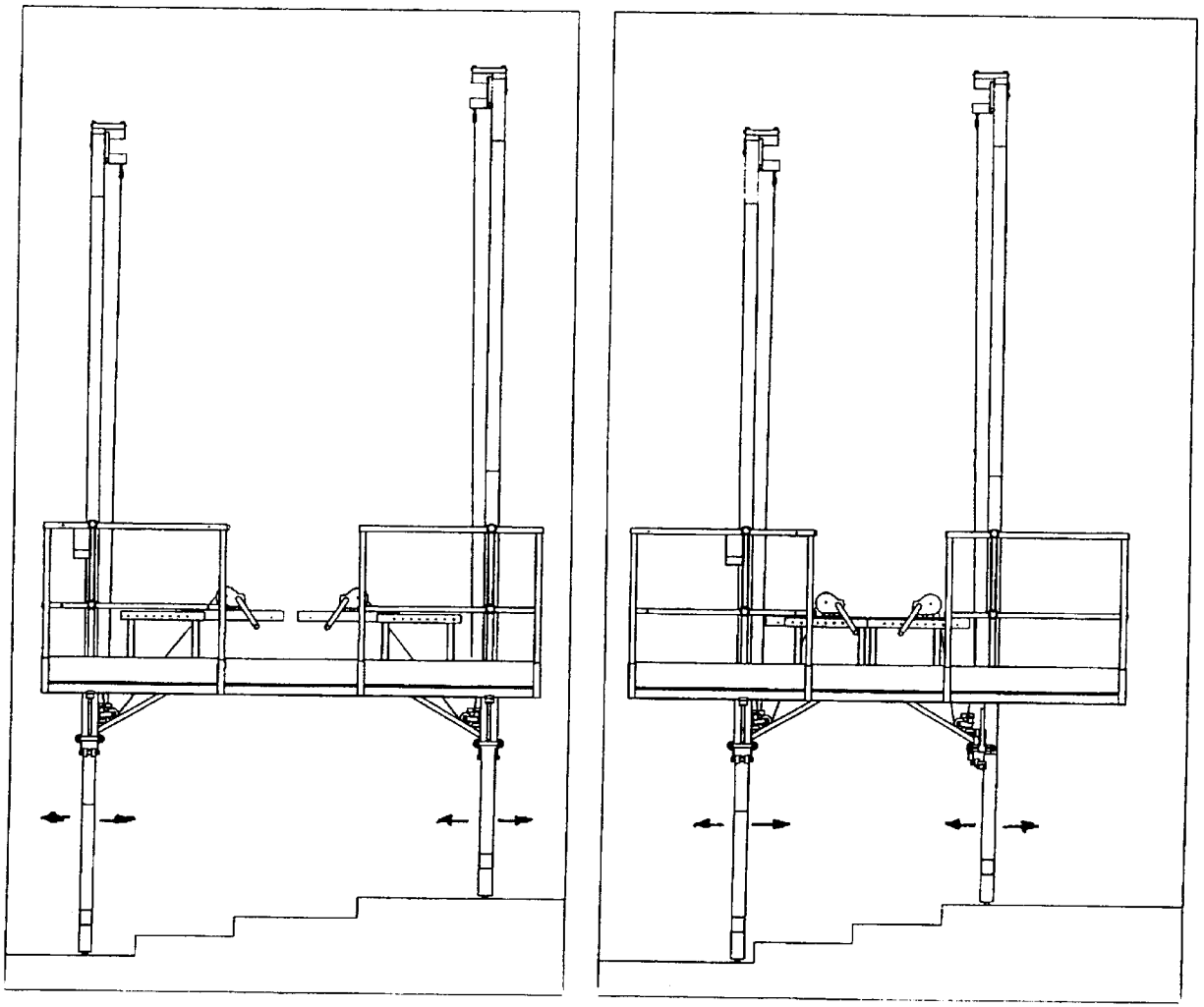

FIG. 6 is a perspective view of the scaffold on an uneven underlying surface and with different distances between the legs.

Figure 1:
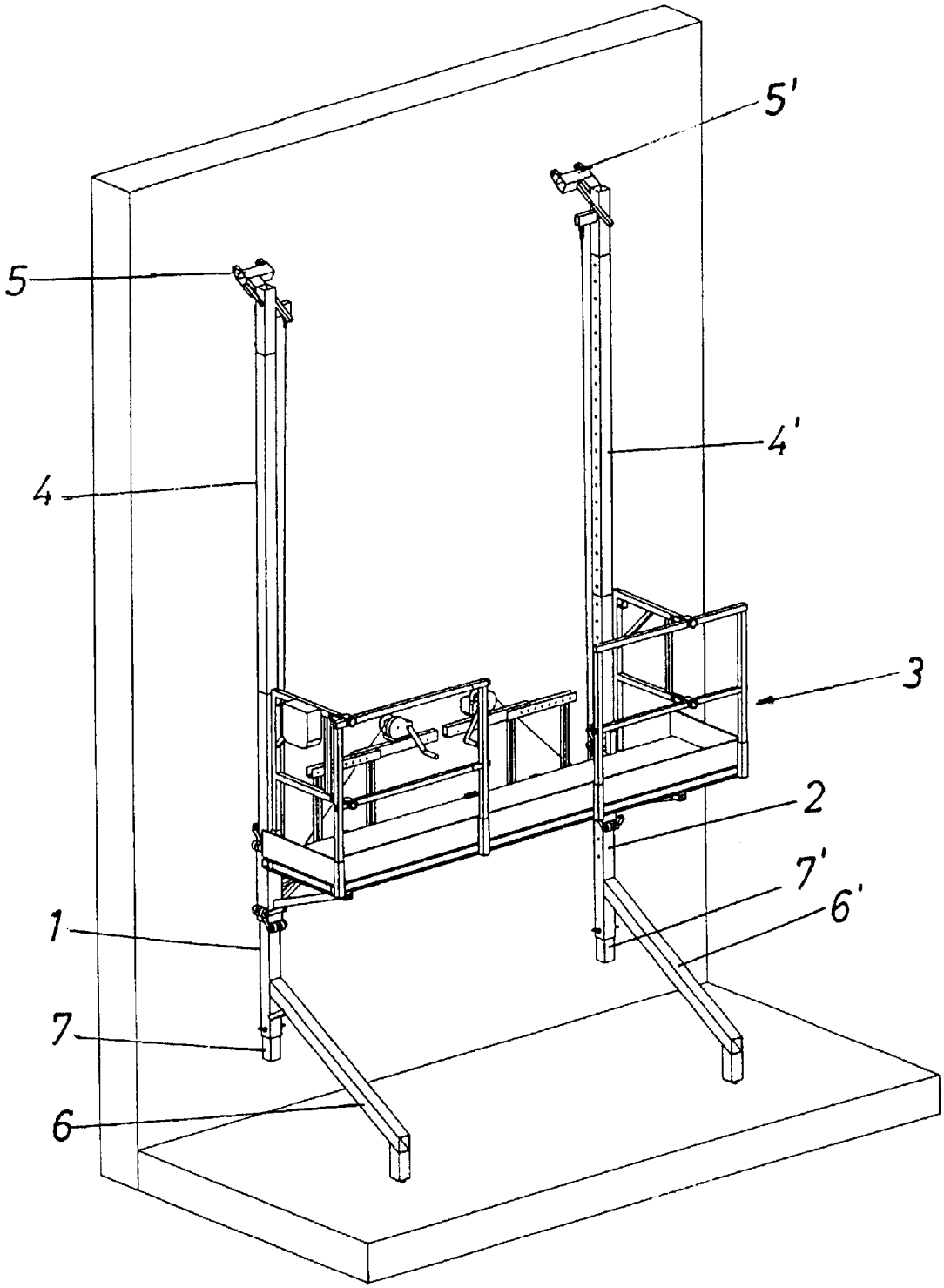
FIG. 1 is a perspective view of the scaffold.

The scaffold consists of at least two legs 1, 2 and at least one platform 3, the figures is showing a scaffold with two legs 1, 2 and one platform 3. FIG. 1 shows the scaffold consisting of two legs 1, 2 and one platform 3, where the respective legs 1, 2, when mounted, have a middle portion 4, 4', which middle portions are substantially parallel with one another and almost parallel with the wall when mounted.

This is achieved in that the middle leg portion 4, 4' at its upper end has a spacer 5, 5' facing in towards the wall, and that the middle leg portion 4, 4' at its lower end has a spacer in the form of a stabilising leg 6, 6' which extends outwards and downwards towards the underlying surface (the ground).

Figure 2:
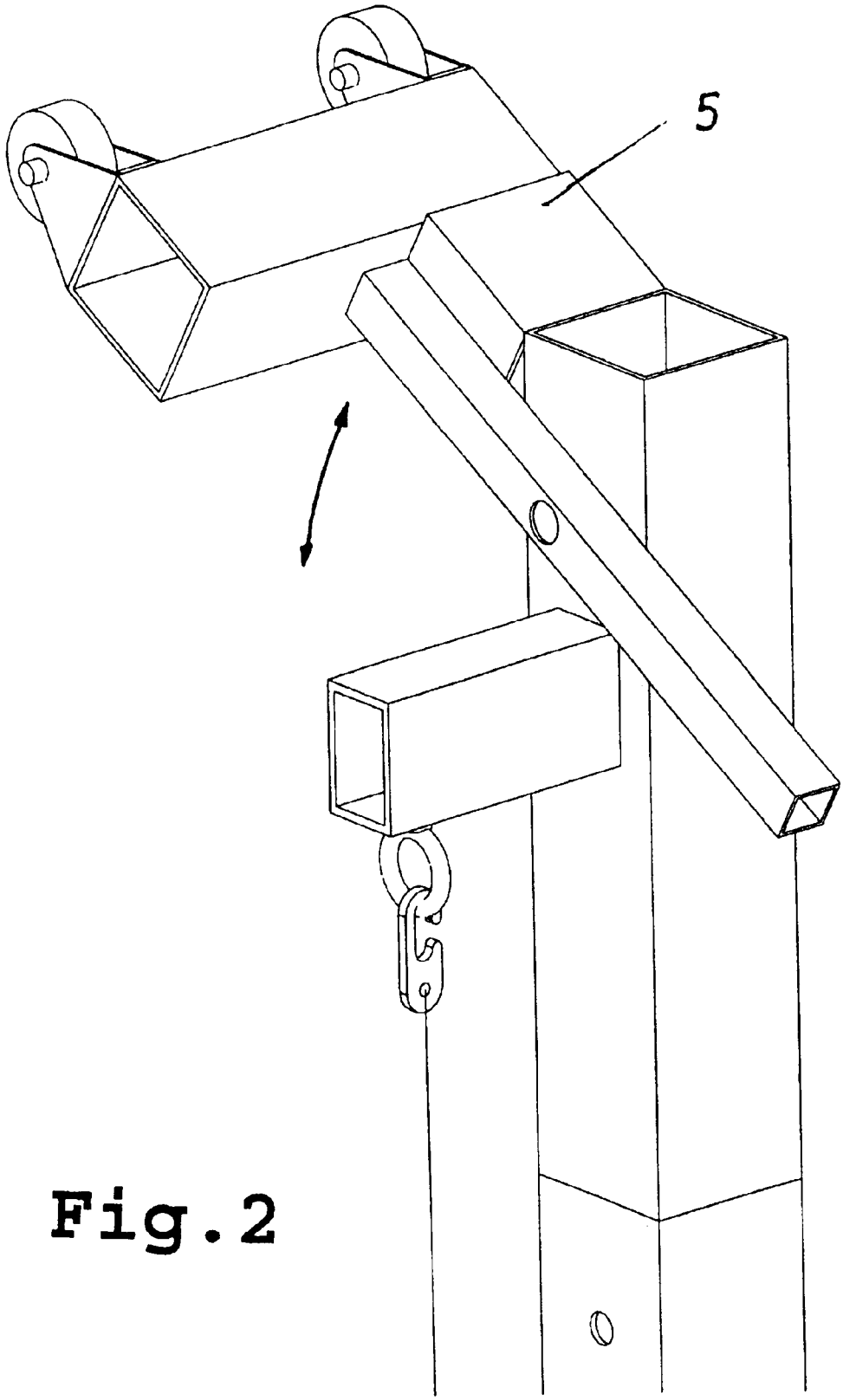
FIG. 2 is a schematic illustration of an example of one leg's support against a wall.

The platform 3 is mounted in horizontal and in movable interaction with the legs 1, 2. The point at which the leg rests against the wall can be moved. This can be achieved by, e.g., designing the spacer at the top 5, 5' to be movable, e.g., rotatable, to enable the user to gain access to the wall in order to paint the whole wall, cf. FIG. 2.

At the bottom of the middle leg portion 4, 4', there may be provided a safety foot 7, 7' which is capable of being moved downwards telescopically so that it almost touches the underlying surface. The purpose of this is to prevent the leg 1, 2 from sliding outwards when the surface is smooth or slippery, since if one leg slides out, the safety foot 7, 7' will come down onto the ground and prevent further sliding. The safety foot 7, 7' does not have any function during normal use, as it will not touch the underlying surface (the ground).

Figure 3:
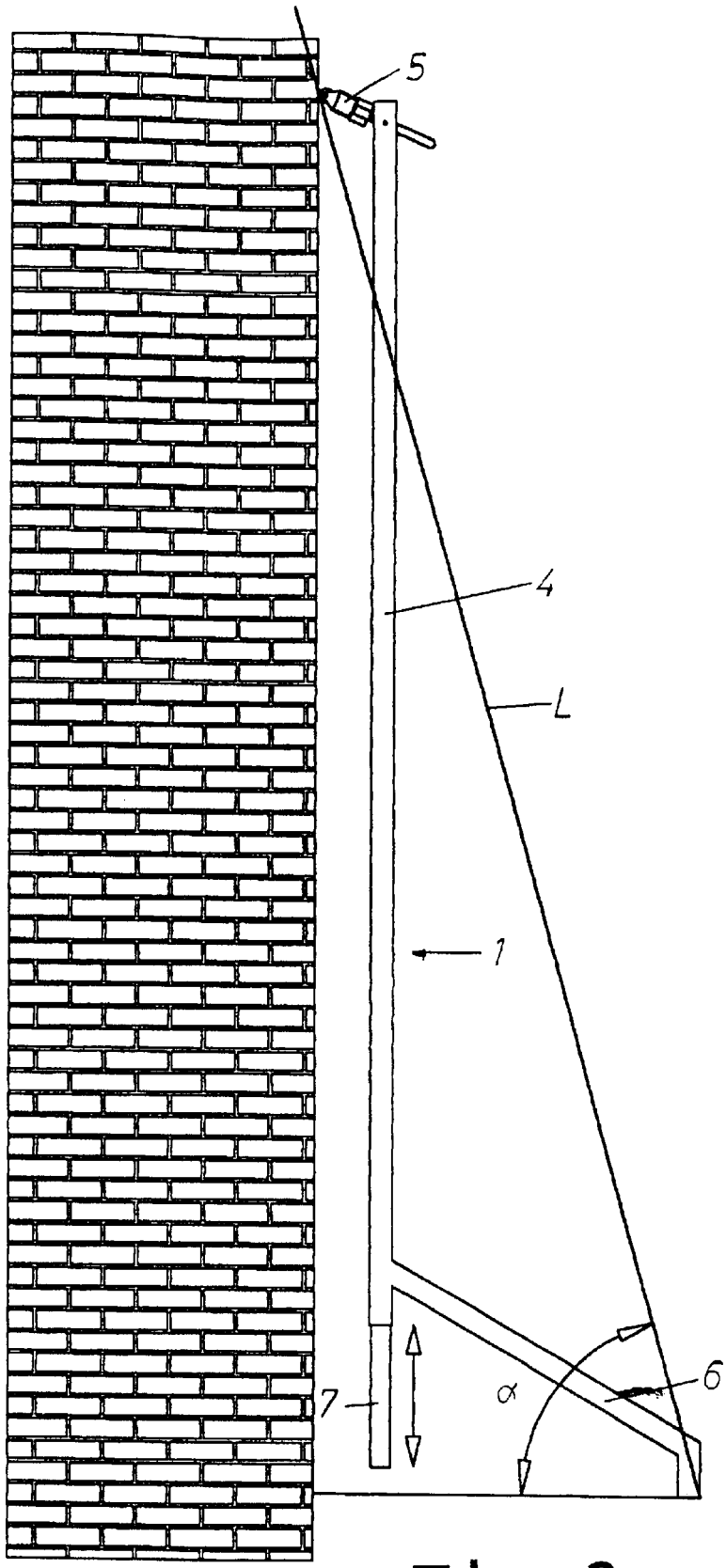
FIG. 3 is a schematic illustration of the relation between a safety foot and the legs in relation to the wall.

An angle $\alpha$ (see FIG. 3), which is formed by a straight line L from the point at which the leg 1 touches the wall via the spacer 5 and the point at which the stabilising leg 6 touches the underlying surface, will be greatest in the case of long legs and smallest in the case of short legs. Since the possibility of sliding is greater when the angle is smaller, it is extra important to have the safety foot. FIG. 3 shows a leg that is 5 m in length and an angle of 75 degrees.

FIG. 4*a* shows an example of a platform, including side members 9, 10 having a guard rail 12 above the side member which extends in the longitudinal direction of the platform with a gate-like opening which can be closed by means of sliding bars 11.

FIG. 4*b* shows the connection between platform and legs with a sleeve-like bracket 8, where in this case the right-hand side of the scaffold is shown, the left bracket being identical, but mirror-inverted, and therefore not shown in more detail.

The bracket 8 has a side guard rail 12 mounted thereon, so that this will automatically appear at the right place when the platform 3 is mounted. The brackets 8 have a plurality of rollers 13 to enable the bracket to be moved up and down along the legs 1, 2. Secured to the bracket 8 are bars 14, 17 for attachment of the platform, and also stay bars 16, 16'. A winch 18 adjustable in dependence of the distance between the legs is mounted on the bar 14. (See FIG. 4*b*). Ii is provided a winch for each leg, see FIG. 5, and the distance between the winches are adjustable in such away that it is possible to use the two winches simultaneously using the right and left hand.

A safety brake 19 co-act with holes 20 in the leg and act as a safety mechanism if the wire should snap. (See FIG. 4*b*)

FIG. 4*c* shows the connection between platform and legs. The platform 3 is mounted on the brackets 8. The platform is installed so that the innermost support member 16 on the platform grips around a stabilising bar 14 on the bracket 8.

A locking mechanism 15 on the bracket 8 then clamps an outermost support member 17 onto the platform. The locking mechanism may be, as shown in FIG. 4*b*, a block which act as a stop for the platform and hold the platform on place. The bracket 8 may have a fixedly mounted side guard rail 12 to ensure that it will automatically be placed at the location of the leg.

FIG. 5 shows the scaffold on a sloping underlying surface along a wall, where the legs 1, 2 will rest on different levels whilst the platform 3 is mounted horizontally.

The wall and/or the ground will sometimes call for the legs 1, 2 to be moved inwards or outwards on one of the sides or on both sides.

The distance between the legs 1, 2 can vary, from the outer edge of the platform 3 where maximum distance at the selected length of the platform is obtained, and when the stabilising bars 14 of each of the brackets are close to one another, the smallest distance between the legs will be obtained.

What is claimed is:

1. A scaffold structure comprising:

a first leg, wherein the first leg comprises a first spacer, a first middle leg portion, and a first lower end, wherein the first spacer is rotatably and lockably coupled to the first middle leg portion, and wherein the first lower end forms and angle with the outer side of the first middle leg portion greater than 90 degrees and less than 180 degrees;

a second leg, wherein the second leg comprises a second spacer, a second middle leg portion, and a second lower end, wherein the second spacer is rotatably and lockably coupled to the second middle leg portion, and wherein the second lower end forms an angle with the outer side of the second middle leg portion greater than 90 degrees and less than 180 degrees;

a platform, wherein the platform is adjustably coupled to the first middle leg portion and the second middle leg portion;

a first safety foot and a second safety foot, wherein the first safety foot is coupled to the inner side of the first middle leg portion, and wherein the second safety foot is coupled to the inner side of the second middle leg portion, and wherein each safety foot may be telescopically extended in a substantially upward and downward direction;

wherein the scaffold structure may be erected against a wall wherein its only points of contact with the wall is the first and second spacers;

wherein the first middle leg portion may be independently adjusted with respect to the platform, and wherein the second middle leg portion may be independently adjusted with respect to the platform;

wherein the scaffold structure contacts the ground at only two points, a first point and a second point, wherein the first point of contact with the ground is made via the first lower end of the first leg; and wherein the second point of contact with the ground is made via the second lower end of the second leg.

2. The scaffold structure of claim 1, wherein the platform is mounted to the first middle leg portion via a first sleeve-shaped bracket, and wherein the platform is mounted to the second middle leg portion via a second sleeve-shaped bracket.

3. The scaffold structure of claim 1:

wherein the platform is mounted to the first middle leg portion via a first sleeve-shaped bracket, and wherein the platform is mounted to the second middle leg portion via a second sleeve-shaped bracket;

wherein the first sleeve-shaped bracket is coupled to a plurality of rollers which allow the bracket to move along the first middle leg portion;

wherein the second sleeve-shaped bracket is coupled to a plurality of rollers which allow the bracket to move along the second middle leg portion.

4. A scaffold structure comprising:

a first leg, wherein the first leg comprises a first spacer, a first middle leg portion, and a first lower end, wherein the first spacer is rotatably and lockably coupled to the first middle leg portion, and wherein the first lower end forms and angle with the outer side of the first middle leg portion greater than 90 degrees and less than 180 degrees;

a second leg, wherein the second leg comprises a second spacer, a second middle leg portion, and a second lower end, wherein the second spacer is rotatably and lockably coupled to the second middle leg portion, and wherein the second lower end forms an angle with the outer side of the second middle leg portion greater than 90 degrees and less than 180 degrees;

a platform, wherein the platform is adjustably coupled to the first middle leg portion via a first sleeve-shaped bracket, and wherein the platform is adjustably coupled to the second middle leg portion via a second sleeve-shaped bracket;

a first side member and a second side member, wherein the first and second side members are in a substantially perpendicular orientation to the wall and are coupled to the platform on opposite ends of the platform from each other;

a third side member, wherein the third side member is in a substantially parallel orientation to the wall and is coupled to the platform on the side opposite the wall;

a guard rail, wherein the guard rail is coupled to the first and second sleeve-shaped bracket, and wherein the guard rail comprises sliding bars which form a gate;

a first safety foot and a second safety foot, wherein the first safety foot is coupled to the inner side of the first middle leg portion, and wherein the second safety foot is coupled to the inner side of the second middle leg portion, and wherein each safety foot may be telescopically extended in a substantially upward and downward direction;

wherein the scaffold structure may be erected against a wall wherein its only points of contacts with the wall is the first and second spacers;

wherein the first middle leg portion may be independently adjusted with respect to the platform, and wherein the second middle leg portion may be independently adjusted with respect to the platform; and wherein the scaffold structure contacts the ground at only two points, a first point and a second point, wherein the first point of contact with the ground is made via the first lower end of the first leg, and wherein the second point of contact with the ground is made via the second lower end of the second leg.

* * * * *